United States Patent [19]

Barriquand et al.

[11] Patent Number: 4,581,906

[45] Date of Patent: Apr. 15, 1986

[54] TEXTILE TREATMENT MACHINES

[75] Inventors: Robert Barriquand; Francois Villard, both of Roanne; Raymond Portailler, Renaison; Bernard Barriquand, Roanne, all of France

[73] Assignee: Barriquand, Roanne, France

[21] Appl. No.: 653,587

[22] Filed: Sep. 24, 1984

[30] Foreign Application Priority Data

Sep. 22, 1983 [FR] France ..... 83 15058

[51] Int. Cl.[4] ..... D06B 5/18

[52] U.S. Cl. ..... 68/15; 68/189

[58] Field of Search ..... 68/15, 184, 189

[56] References Cited

U.S. PATENT DOCUMENTS 1,265,332 5/1918 Holt et al. ..... 68/189
3,916,653 11/1975 West et al. ..... 68/189 X
4,217,768 8/1980 Sugimoto ..... 68/189 X
4,452,055 6/1984 Lejeune et al. ..... 68/189
4,516,413 5/1985 Barriquand et al. ..... 68/189 X

FOREIGN PATENT DOCUMENTS 538410 6/1955 Belgium ..... 68/189

*Primary Examiner*—Philip R. Coe
*Attorney, Agent, or Firm*—Oblon, Fisher, Spivak, McClelland & Maier

[57] ABSTRACT

A machine for the liquid or gaseous treatment of textiles or other fibrous or porous materials, which comprises a partition (9) located in its end zone opposite its cover (2), which partition (9) forms, with the bottom of the machine (1) and the corresponding part of its side walls (14), a leaktight box which delimits an expansion zone for the treatment fluid, that part of the machine which is located between the cover (2) and the partition (9) forming the actual treatment zone (10), which accommodates at least one holder for the material, the machine further comprising a device for the circulation of the treatment fluid.

18 Claims, 9 Drawing Figures

TEXTILE TREATMENT MACHINES

FIELD OF THE INVENTION

The present invention relates to an improved machine for the liquid treatment (with water, solvents etc.) or gaseous treatment (for example with foam) of textiles, and especially for the washing, bleaching or dyeing of textiles in different forms: flock, combed tops, spun fiber yarns, filament, flat, textured or shrunk yarns, spun fiber yarns with a filament yarn core, woven fabrics or knitted fabrics.

PRIOR ART

The present invention relates to a machine with a horizontal tank. Machines are known for the washing, bleaching and dyeing of textiles at a high temperature capable of reaching 140° C., in which the treatments are carried out by circulating the bath through the static textile. In this case, the textile is loaded horizontally into the machine: packing, flock, bobbins of combed tops, stacked bobbins of spun fiber yarns or filament yarns, beamed yarn lap, or beamed knitted fabrics or woven fabrics, i.e. fabrics wound around a perforated tube called a beaming slide.

In these machines, the static pressurization of the bath heated to a high temperature is carried out by several known methods:

circuit of the external bath in an expansion vessel which is either closed or open. In this case, the bath of the expansion vessel is generally taken up by an injection and static pressurization pump in order to be returned to the autoclave apparatus via pipes.

In the case where the expansion vessel is open, there is a device for cooling the bath upstream of the expansion vessel to below 100° C., for example to 80° C.

expansion of the bath inside the autoclave itself, in a space located above the material: in this case, the holder for the material is offset downwards so that, with the material covered by the bath, there remains sufficient space available above it for expansion.

Although the technical performance characteristics of these machines are good, it proves necessary to improve them further by making the greatest possible reduction in the volume of the treatment bath in circulation, while at the same time avoiding the systematic cooling of the bath, and consequently by reducing the energy consumption.

SUMMARY OF THE INVENTION

The object of the present invention was consequently to design a machine for the treatment of textiles or other fibrous or porous materials in a liquid or gaseous medium, such as a washing, bleaching or dyeing treatment, which satisfies the practical requirements even better than the machines of the same type proposed in the prior art, by permitting a substantial reduction in the energy consumption of this type of machine, this being associated with a reduction in the volume of the treatment bath in circulation, with its expansion circuit and with the regulation of its flow rate through the material, as a result of improvements made to these machines.

The present invention relates to a machine for the liquid or gaseous treatment of textiles or other fibrous or porous materials, and especially for the washing, bleaching and dyeing of textiles, which is of the type having a tank with a horizontal axis which houses a treatment zone equipped with at least one holder for the material to be treated, and an expansion zone for the treatment fluid, which is located in the end zone of the tank opposite the end zone possessing the tank cover, and is separated from the treatment zone by a partition, which machine also comprises means for circulating the treatment fluid and a heat exchanger for the treatment fluid in circulation, wherein the partition which delimits firstly the expansion zone and secondly the treatment zone, in the machine, is a non-leaktight partition allowing communication between the said two zones and the passage of the whole of the bath from one zone to the other, the means for circulating the treatment fluid comprise, in combination, a pipe with a horizontal axis, which is mounted essentially along the axis of the machine and one of the ends of which is housed in the partition, a side opening made in the bottom of the machine, and a pump for circulating the bath, which is arranged on the outside of the machine and connected firstly to the other end of the pipe and secondly to the side opening by a pipe, the said means for circulating the bath constituting a short and compact circuit of low energy consumption, the said short and compact circuit includes a heat exchanger in which the whole of the treatment fluid taken up by the pump circulates, and communicates with the expansion zone by way of the opening, and means for bringing the treatment zone into direct communication with the expansion zone are provided inside the machine in order to allow the whole of the bath to circulate between the said zones.

The arrangement of an expansion zone of this type in a leaktight box delimited by the bottom of the machine and the said partition permits a reduction in the bath ratio and hence savings of energy (a smaller volume of heated bath), water and treatment products (for example dyeing products), and consequently a reduction in pollution.

In an advantageous embodiment of the treatment machine forming the subject of the present invention, the heat exchanger is mounted in a housing provided for accommodating it in the said expansion zone and associated with the means for bringing the treatment tank into communication with the expansion zone.

In an advantageous arrangement of this embodiment, the said housing is non-leaktight and ensures communication between the treatment tank and the expansion zone.

In another advantageous arrangement of this embodiment, the said housing is leaktight and the connection between the treatment tank and the expansion zone is ensured by a tube, at least part of which passes through the expansion zone and comes out in the said leaktight housing.

In another advantageous embodiment of the treatment machine forming the subject of the present invention, the heat exchanger is mounted in a connection pipe between the pump for circulating the treatment fluid and the treatment tank.

In yet another advantageous embodiment of the treatment machine forming the subject of the present invention, the machine comprises means for automatically controlling the pressures prevailing respectively in the expansion zone and the treatment tank, which make it possible to control the heights of the treatment bath level in the expansion zone and in the treatment tank and also, if appropriate, to work with a reduced volume of bath in the treatment tank, which is proportional to a quantity of material to be treated which is introduced into the said tank, this quantity being less than the treatment capacity of the machine.

In an advantageous arrangement of this embodiment, the said means for automatically controlling the pressures prevailing respectively in the expansion zone and in the treatment tank consist of means for introducing controlled quantities of a compressed gas into the treatment tank and/or into the expansion zone.

In another advantageous embodiment of the machine according to the present invention, the pump for circulating the treatment fluid is a centrifugal pump allowing the said fluid to circulate in only one direction.

In an advantageous arrangement of the invention, the pump for circulating the treatment fluid is a centrifugal pump equipped with a reversing device in order to allow the said fluid to circulate alternately in two opposite directions.

In another advantageous arrangement of the invention, the pump for circulating the treatment fluid is a propeller pump which allows the said fluid to circulate alternately in two opposite directions.

In yet another advantageous arrangement of the invention, the pump for circulating the treatment fluid is driven by a variable-speed motor.

In an advantageous embodiment of the said partition, the latter consists of an internal metal wall which possesses an axial opening capable of accommodating the corresponding end of the abovementioned axial pipe in order to bring the treatment tank into communication with the circulating pump.

In another advantageous embodiment of the treatment machine forming the subject of the invention, the machine is equipped with a device for accommodating the holders for the material, which is located at the inner end of the abovementioned axial pipe and comprises a plinth fixed to the said pipe and carrying a cone for accommodating the said holders.

In an advantageous arrangement of this embodiment, the holder is joined to the accommodating device by means of a suitable device which makes it possible to position a holder of reduced capacity, not occupying the whole of the said first zone of the machine tank, at any level in the machine and especially as low as possible therein so as to reduce the volume of the bath even more.

According to the invention, packing bodies are provided on the holders in order to occupy the dead zones situated between the stacks of material to be treated which are carried by the holders, thus additionally reducing the internal volume of the machine and consequently the volume of bath in circulation.

In an advantageous arrangement of this embodiment, the said packing bodies are fixed to the holders.

In another advantageous arrangement of this embodiment, the packing bodies provided between the holders are fixed not to the holders but to the partition.

This arrangement offers an important advantage in the case of a detachable partition fixed to the packing bodies, in view of the fact that it is possible to position in the machine a detachable unit of partition/packing bodies for the treatment of materials on a given type of holder and remove it in order to replace it with another unit, also detachable, suitable for types of holders having different dimensions, for example carrying bobbins having a different diameter from those capable of being carried by the previous type of holder.

Also according to the invention, the boxes for distributing the treatment bath, which are associated with the holders in a known manner, are provided with perforations which ensure that the bath returns more rapidly to the bottom of the machine and that, as a result, it is taken up more rapidly by the pump.

Apart from the foregoing arrangements, the invention also includes other arrangements which will become apparent from the description below.

BRIEF DESCRIPTION OF THE DRAWINGS

The invention will be understood more clearly with the aid of the following complementary description referring to the attached drawings; in these drawings.

Figure 1:
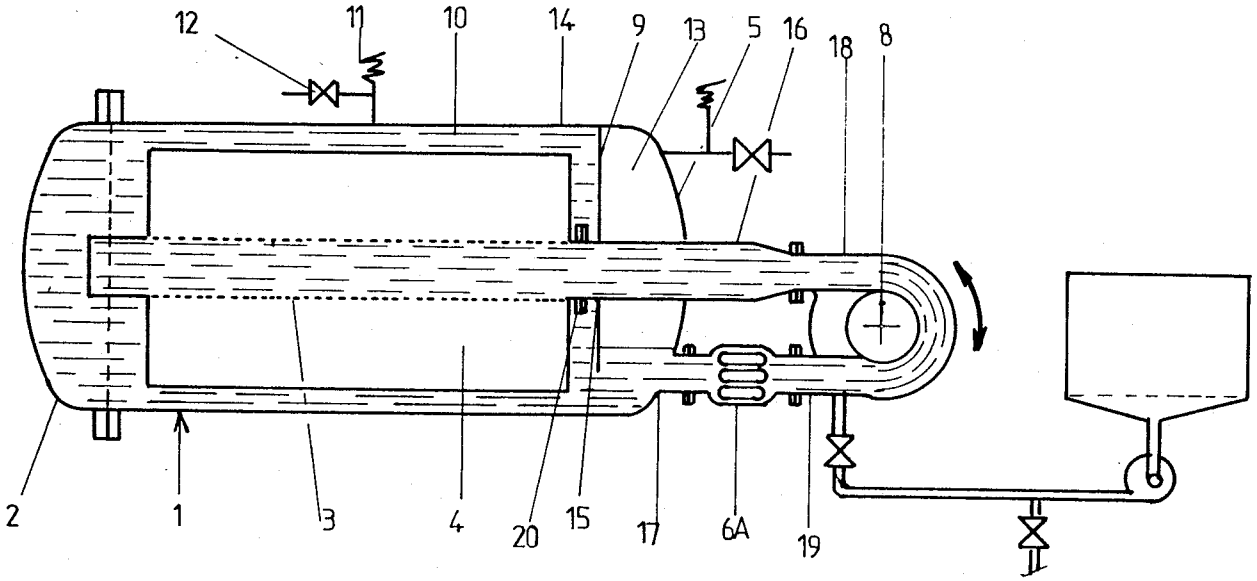
FIG. 1 is a schematic view in longitudinal section of an embodiment of the machine for the treatment of textiles or the like, according to the present invention, in which the heat exchanger is outside the machine.

It must be clearly understood, however, that these drawings and the corresponding descriptive sections are given solely as an illustration of the subject of the invention and they in no way imply a limitation thereof.

DETAILED DESCRIPTION

The machine shown in FIGS. 1 to 5 for the liquid or gaseous treatment of textiles or other fibrous or porous materials consists of a horizontal autoclave designated as a whole by reference number 1, for the treatment of textiles or the like contained in a tank 10 and carried by holders 3, by the circulation of a treatment bath in the said tank 1. This machine is closed by a cover 2 and has a bottom 5 at its end opposite the cover 2. A partition 9 is arranged in the autoclave 1, in the vicinity of the bottom 5, in a position essentially perpendicular to the horizontal axis of the autoclave 1. This partition 9 delimits, in the autoclave, a first zone between the cover 2 and this partition 9, which constitutes the actual treatment tank 10, and a second zone defined by this partition 9, the bottom 5 and the corresponding part of the side wall 14 of the autoclave, which constitutes a chamber 13 containing the expansion zone for the treatment bath.

The partition 9 possesses an essentially axial opening 15 intended for accommodating one of the ends of a pipe 16 having a horizontal axis. A side opening 17 is made in the bottom 5 of the machine. At its other end, the pipe 16 is joined to an external pump 8 by a pipe 18 and the opening 17 is also joined to the said pump 8 by a pipe, as described below.

Figure 2:
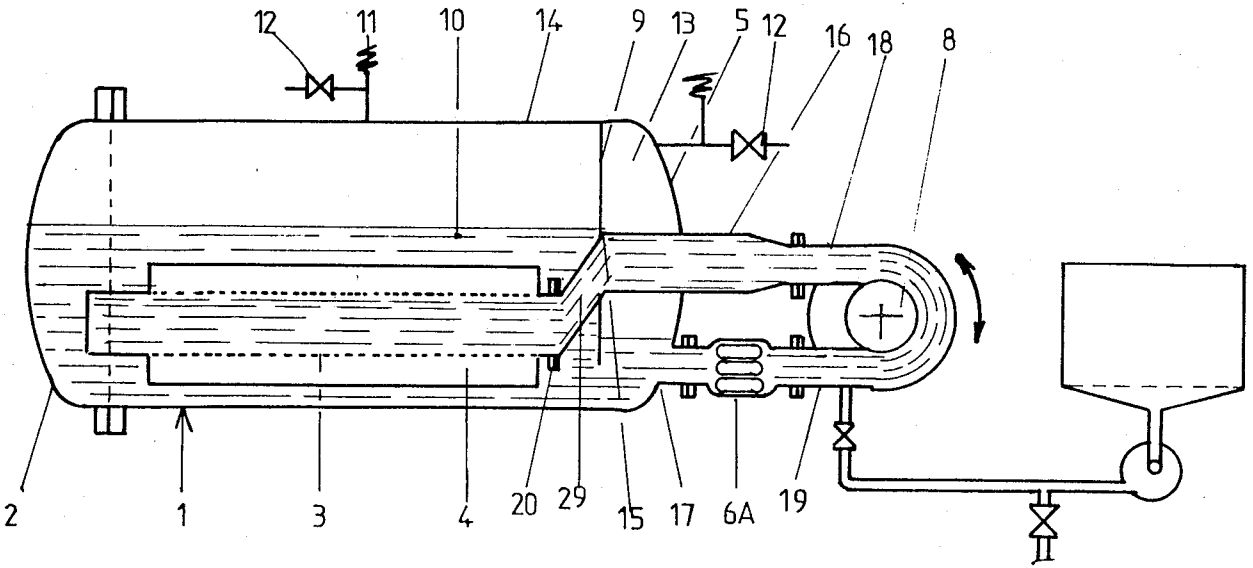
FIG. 2 is a schematic view in longitudinal section of an embodiment of the treatment machine according to the invention which contains a holder of reduced capacity, i.e. not occupying the entire autoclave tank, and in which the heat exchanger is outside the machine.
Figure 8:
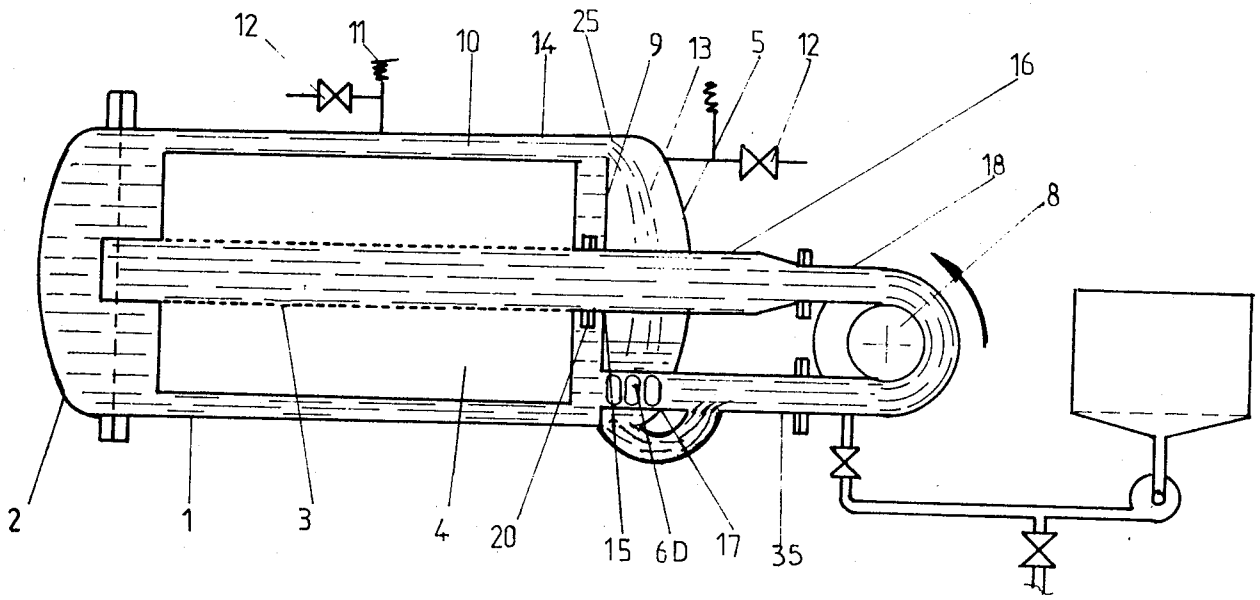
FIG. 8 is a schematic view in longitudinal section of an embodiment of the machine for the treatment of textiles or the like, according to the present invention, in which the heat exchanger is housed in part of the connecting pipe between the pump for circulating the treatment fluid and the treatment tank, which is located inside the expansion zone.

In the embodiments shown by way of non-limiting examples in FIGS. 1, 2 and 8, a heat exchanger 6A, 6D is mounted in the pipe 19 which joins the side opening 17, made in the bottom 5 of the autoclave 1, to the pump 8. However, whereas in the embodiments shown in FIGS. 1 and 2 the heat exchanger 6A is arranged in the pipe 19 outside the autoclave 1, in the embodiment shown in FIG. 8 the heat exchanger 6D is housed in a pipe 35 which joins the pump 8 to the treatment tank 10, and, more precisely, inside the expansion zone 35 which is located inside the expansion zone 13, the inner end of the said pipe 35 coming out in the partition 9.

Figure 3:
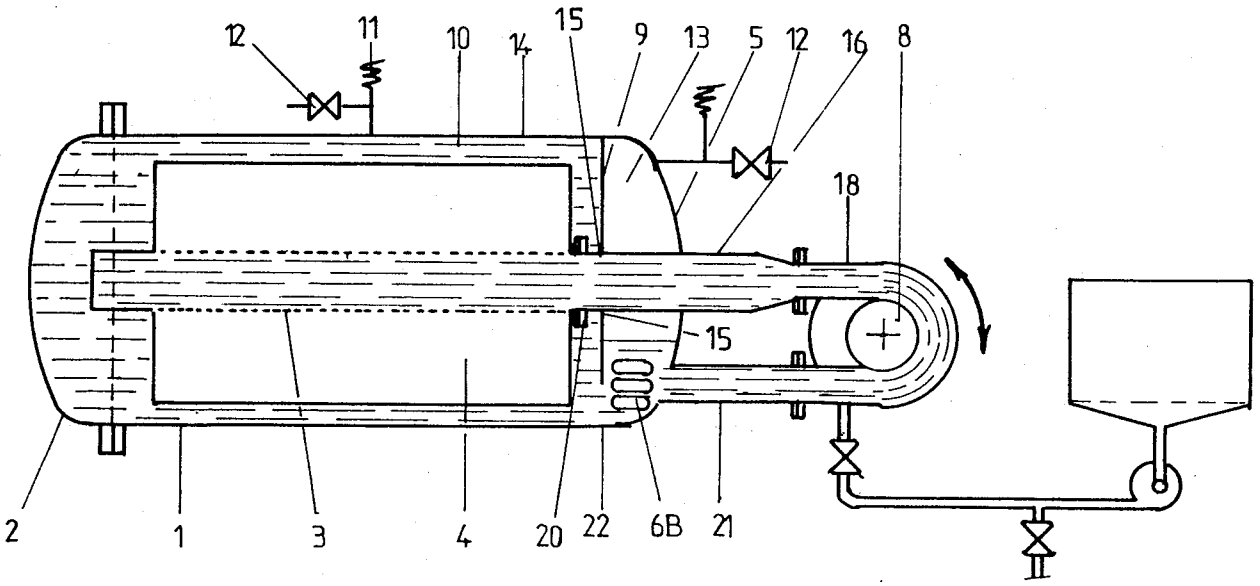
FIGS. 3 to 5 are schematic views in longitudinal section of embodiments of the treatment machine according to the invention in which the heat exchanger is housed in the expansion zone of the machine.
Figure 4:
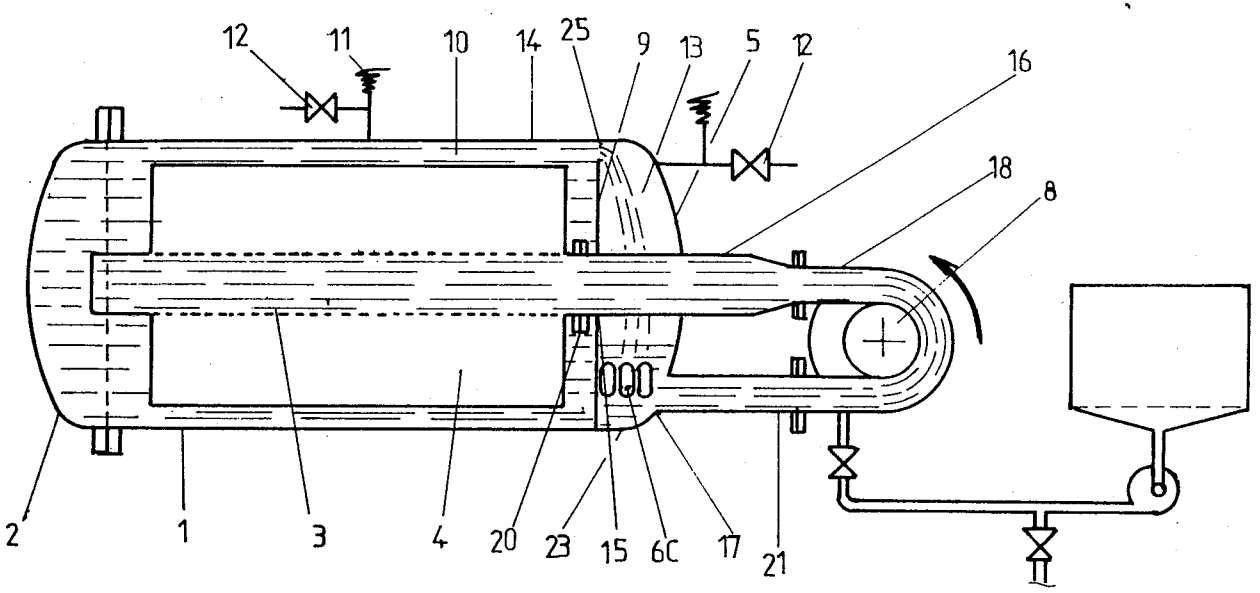
Figure 5:
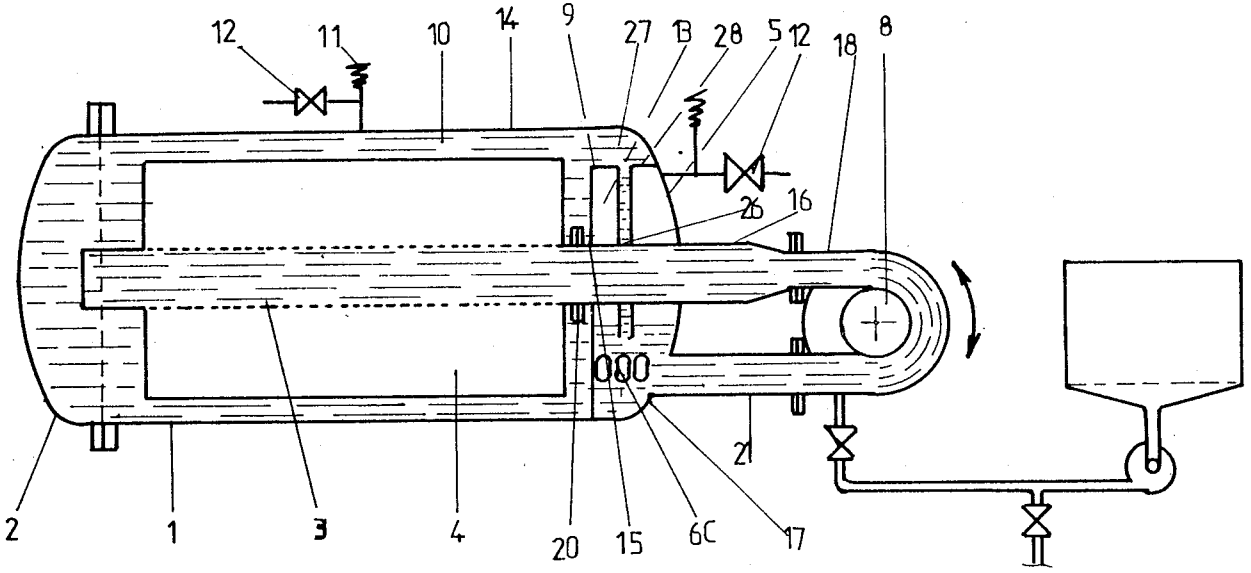

In the embodiments shown by way of non-limiting examples in FIGS. 3 to 5, the opening 17 is joined directly to the pump 8 by a pipe 21 and the heat exchanger is placed in a housing provided in the expansion zone 13, in the lower part of the latter, facing the opening 17. In the embodiment shown in FIG. 3, the heat exchanger 6B is placed in a non-leaktight housing 22 which joins the treatment tank 10 to the expansion zone 13. In the embodiment shown in FIGS. 4 and 5, the heat exchanger 6C is placed in the housing 23, which is leaktight in relation to the treatment tank 10, and the connection between the latter and the expansion zone 13 is ensured by an opening 25 made in the partition 9 (cf. FIG. 4), or by a tube which can join the housing 23 to the opening 25 made in the partition 9, or by a tube 26 (cf. FIG. 5) which joins the tank 10 to the housing 23 via an extension 27 of the said tank 10 located between the wall 14 of the autoclave and a wall 28 which delimits the expansion zone 13 in conjunction with the partition 9, the bottom 5 and the upper wall of the housing 23.

Another variant (not shown) for bringing the tank 10 into communication with the expansion zone 13 can provide for the arrangement of an external pipe having a horizontal axis, which runs along the autoclave above the tank 1 and is joined to the latter by one or more tubes, this pipe undergoing a 90° change in direction, beyond the partition 9, so that it can enter the expansion zone 13, through a leaktight opening made for this purpose in the upper part of the said zone, as far as its connection to the housing 23.

The pump 8 for circulating the treatment bath is of any suitable type and can be, in particular, either a centrifugal pump which may or may not be equipped with a reversing tap system capable of ensuring a reversible circulation, or a propeller pump ensuring that the bath circulates from the opening 17 in the direction of the pipe 16 or in the opposite direction. In the case of the centrifugal pump not equipped with a reversing tap, the bath can circulate only in the direction from the opening 17 towards the pipe 16, which is generally suitable for the treatment of yarns, woven fabrics or knitted fabrics wound onto beaming slides.

The drive motor of the pump 8 can be a variable-speed motor.

The use of a variable-speed motor to drive the bath-circulating pump makes it possible to control and adjust the flow rate of the bath through the material, as well as the variations in flow rate, for example when the pump is started.

Figure 6A:
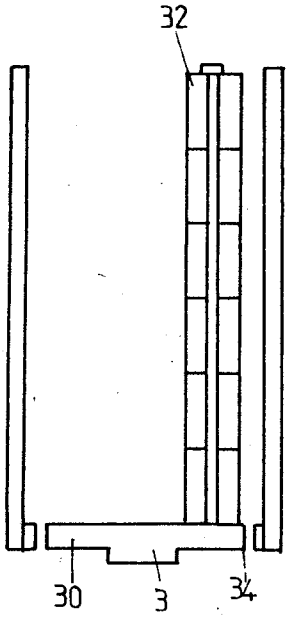
FIG. 6*a* is a schematic view in longitudinal section of a holder carrying stacks of bobbins, with packing bodies fixed to the holder.

A plinth 20 fixed to the pipe 16 carries a cone or the like (not shown) for accommodating the holders 3 for the material, through which the bath can be distributed, as required, for example for the treatment of bobbins, via a box 30 (cf. FIG. 6*a*) provided with perforations 34 so that the bath returns rapidly to the bottom of the tank 10 in order to be taken up by the pump 8.

The autoclave 1 is placed under static pressure by means of a compressed gas, such as compressed air, which is introduced through the valves 12 each fitted with an air bleed. The introduction of compressed gas makes it possible to control the heights of the bath level in the expansion zone 13 and in the treatment zone 10. In fact, if the autoclave 1 is filled with compressed gas by bleeding near the tank 10 and closing near the partition 9, the level will settle in the said partition in such a way that the pressure of compressed gas prevailing in the partition is equal to the difference in level between the tank 10 and the partition 9. To reduce the volume of bath, i.e. to prevent the bath level from rising into the partition 9, it is desirable, in such a case, to inject compressed air into the partition during filling, so as to stabilize the level at the desired value.

The machine according to the invention can operate at full capacity or at reduced capacity. In the latter case, a device 29 makes it possible to join the holders 3 of reduced capacity to the accommodating cone, while at the same time placing them as low as possible in the tank 10, which makes it possible to adjust the level of the bath to the top part of the holders without it being necessary to fill the tank 10 completely. In the case of reduced production, it is thus possible to reduce the volume of bath and the consumption of water, treatment chemicals and heat energy, these consumptions being adapted to the reduction in the quantity of textiles 4 to be treated which are present in the tank 10. In this case, expansion takes place not only in the expansion zone 13 but also in the zone 16 of the tank 10 which surmounts the holders 3.

In this case where the volume of bath is reduced in order to adapt to reduced production, the pressure difference between the expansion zone 13 and the treatment zone 10 corresponds to the difference in bath level between these two zones 13 and 10, to which there should be added or from which there should be subtracted, according to the direction of circulation of the treatment bath, the pressure losses across the communication circuit between the treatment zone 10 and the expansion zone 13; to obtain the desired bath levels, it is thus necessary to control the pressures between these two zones by regulating the respective introduction of compressed gas into these two zones by means of the valves 12, as indicated above.

Figure 7:
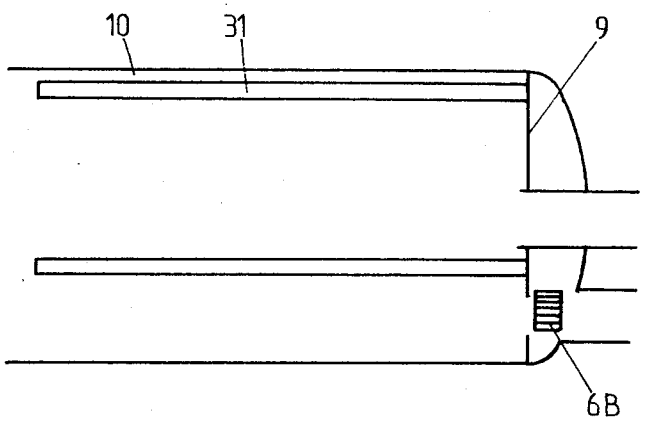
FIG. 7 is a schematic view in longitudinal section of packing bodies fixed to the partition, according to the invention, of the autoclave.
Figure 6B:
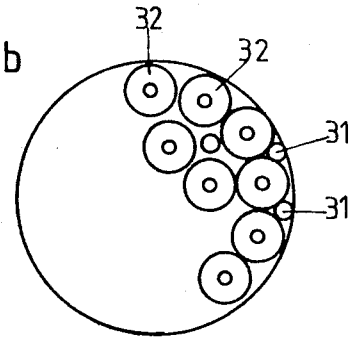
FIG. 6*b* is the corresponding view in cross-section.

It is also possible to reduce the volume of bath by equipping the autoclave with horizontal packing bodies 31 which occupy the dead zones between stacks 32 of textiles to be treated which are carried by holders 3 (FIGS. 6 and 7).

By virtue of the combination of the partition 9 and the packing bodies 31, a machine for the liquid or gaseous treatment of textiles or other fibrous or porous materials is obtained in which the volume of bath, or bath ratio, necessary for the treatment is considerably reduced by comparison with the known machines of the prior art, this reduction affording a saving of water and a saving of energy as a result of the reduction in the quantities of water required for the treatment, and an improved productivity.

Furthermore, the polluting effluents (chemicals, colorants) are consequently reduced, representing a considerable decrease in environmental pollution.

Moreover, the particular arrangement of the pump and the use of a variable-speed drive motor have the effect of optimizing the performance characteristics of the pump and reducing the energy consumption for operating the pump, taking account of the treatment bath circuit.

In addition, the internal expansion of the bath makes it possible to save the heat energy lost by cooling due to external expansion.

The experiments performed by the Applicant Company have shown that the machine according to the invention permits water and energy savings of 20 to 30% compared with the performance characteristics of the best of the known machines intended for the same purpose.

As is apparent from the foregoing text, the invention is in no way limited to those embodiments and methods of application which have now been described more explicitly; on the contrary, it includes all the variants thereof which may occur to those skilled in the art, without deviating from the framework or the scope of the present invention.

What is claimed is:

1. A machine for the liquid or gaseous treatment of textiles or other fibrous or porous materials, and especially for the washing, bleaching and dyeing of textiles, which machine comprises a tank with a horizontal axis, said tank defining a treatment zone equipped with at least one holder for the material to be treated and two end zones, one of which is covered and the other of which contains an expansion zone for the treatment fluid, said expansion zone being separated from the treatment zone by a partition, wherein the partition (9), which delimits firstly the expansion zone (13) and secondly the treatment zone (10), is a non-leaktight partition allowing communication between the treatment and expansion zones and the passage of the whole of the bath from one zone to the other, the machine also comprises means for circulating the treatment fluid including, in combination, a pipe (16) with a horizontal axis, said pipe being mounted essentially along the axis of the tank and one end of the pipe being housed in the partition (9), a side opening (17) in the bottom (5) of the tank, and a pump (8) for circulating the bath, said pump being arranged on the outside of the tank and connected firstly to the other end of the pipe (16) and secondly to the side opening (17) by a pipe, the means for circulating the bath constituting a short and compact circuit of low energy consumption, the short and compact circuit includes a heat exchanger in which the whole of the treatment fluid taken by the pump (8) circulates, and communicates with the expansion zone (13) by way of the side opening (17), and means for bringing the treatment zone (10) into direct communication with the expansion zone (13) are provided inside the tank in order to allow the whole of the bath to circulate between the treatment and expansion zones.

2. The treatment machine as claimed in claim 1, wherein the heat exchanger (6B, 6C) is mounted in a housing (22, 23) provided for accommodating it in the expansion zone (13) and associated with the means for bringing the treatment zone (10) into communication with the expansion zone (13).

3. The treatment machine as claimed in claim 2, wherein the housing (22) is non-leaktight and ensures communication between the treatment zone (10) and the expansion zone (13).

4. The treatment machine as claimed in claim 2, wherein the housing (23) is leaktight and the connection between the treatment zone and the expansion zone is ensured by a tube (26), at least part of which tube passes through the expansion zone (13) and comes out in the said leaktight housing (23).

5. The treatment machine as claimed in claim 1, wherein the heat exchanger (6A) is mounted in a connection pipe (19 or 35) between the pump (8) for circulating the treatment fluid and the treatment zone (10).

6. The treatment machine as claimed in any one of claims 1 to 5, which comprises means (12) for automatically controlling the pressures prevailing respectively in the expansion zone (13) and the treatment zone (10), which make it possible to control the heights of the treatment bath level in the expansion zone (13) and the treatment zone (10) and also, if appropriate, to work with a reduced volume of bath in the treatment zone (10), which is proportional to a quantity of material to be treated which is introduced into the tank, this quantity being less than the treatment capacity of the machine.

7. The treatment machine as claimed in claim 6, wherein the means for automatically controlling the pressures prevailing respectively in the expansion zone and the treatment zone consist of means (12) for introducing controlled quantities of a compressed gas into the treatment zone (10) and/or into the expansion zone (13).

8. The treatment machine as claimed in any one of claims 1 to 6, wherein the pump (8) for circulating the treatment fluid is a centrifugal pump allowing the fluid to circulate in only one direction.

9. The treatment machine as claimed in claim 8, wherein the pump for circulating the treatment fluid is driven by a variable-speed motor.

10. The treatment machine as claimed in any one of claims 1 to 6, wherein the pump (8) for circulating the treatment fluid is a centrifugal pump equipped with a reversing device in order to allow the fluid to circulate alternately in two opposite directions.

11. The treatment machine as claimed in any one of claims 1 to 5, wherein the pump (8) for circulating the treatment fluid is a propeller pump which allows the fluid to circulate alternately in two opposite directions.

12. The treatment machine as claimed in any one of claims 1 to 6, wherein the partition (9) consists of an internal metal wall which possesses an axial opening (15) capable of accommodating the corresponding end of the abovementioned axial pipe (16) in order to bring the treatment zone (10) into communication with the circulating pump (8).

13. The treatment machine as claimed in any one of claims 1 to 5, which is further equipped with a device for accommodating the at least one holder (3) for the material, which accommodating device is located at the inner end of the axial pipe (16) and comprises a plinth (20) fixed to the pipe (16) and carrying a cone for accommodating the at least one holder.

14. The treatment machine as claimed in claim 13, wherein the holder (3) is joined to the accommodating device (20) by means of a device (29) which makes it possible to position a holder of reduced capacity, not occupying the whole of the said treatment zone (10), at any level in the machine and especially as low as possible therein so as to reduce the volume of the bath even more.

15. The treatment machine as claimed in any one of claims 1 to 5, wherein plural holders are provided and packing bodies (31) are provided on the holders (3) in order to occupy dead zones situated between stacks of material to be treated which are carried by the holders (3), thus additionally reducing the internal volume of the machine and consequently the volume of bath in circulation.

16. The treatment machine as claimed in claim 15, wherein the packing bodies (31) are fixed to the holders (3).

17. The treatment machine as claimed in claim 15, wherein the packing bodies (31) provided between the holders (3) are fixed not to the holders but to the partition (9).

18. The treatment machine as claimed in any one of claims 1 to 5, wherein boxes (30) for distributing the treatment bath, which are associated with the at least one holder (3), are provided with perforations (34) which ensure that the bath returns more rapidly to the bottom of the treatment zone (10) and that, as a result, it is taken up more rapidly by the pump (8).

* * * * *